US010605211B2

(12) United States Patent
Chu

(10) Patent No.: US 10,605,211 B2
(45) **Date of Patent: *Mar. 31, 2020**

(54) INTAKE PORT

(71) Applicants: Hyundai Motor Company, Seoul (KR); KIA Motors Corporation, Seoul (KR)

(72) Inventor: Jiro Chu, Gyeonggi-do (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/157,633

(22) Filed: Oct. 11, 2018

(65) Prior Publication Data

US 2019/0186443 A1 Jun. 20, 2019

(30) Foreign Application Priority Data

Dec. 18, 2017 (KR) ..... 10-2017-0174091

(51) Int. Cl.
*F02M 35/10* (2006.01)
*F02M 35/108* (2006.01)

(52) U.S. Cl.
CPC .... *F02M 35/108* (2013.01); *F02M 35/10104* (2013.01); *F02M 35/10124* (2013.01)

(58) Field of Classification Search
CPC ..... F02M 35/108; F02M 35/10124; F02M 35/10104
USPC ..... 123/302, 306, 308, 184.45, 184.52
See application file for complete search history.

(56) References Cited

U.S. PATENT DOCUMENTS 3,903,849 A * 9/1975 List ..... F02F 1/4214 123/308
4,669,434 A * 6/1987 Okumura ..... F02B 31/085 123/188.14
4,699,104 A * 10/1987 Okumura ..... F02B 31/082 123/188.14
4,760,821 A * 8/1988 Aupor ..... F02B 31/06 123/188.14
6,250,281 B1 * 6/2001 Takii ..... F02F 1/4214 123/188.14
6,526,940 B2 * 3/2003 Ichikawa ..... F02B 31/02 123/188.14
6,799,551 B2 * 10/2004 Nakakita ..... F02B 23/0621 123/279

(Continued)

*Primary Examiner* — Hai H Huynh
(74) *Attorney, Agent, or Firm* — Brinks Gilson & Lione

(57) ABSTRACT

An intake port may include a short port and a long port. The short port may include a main extension portion extending from an intake air inlet; a main inclined portion inclined at a predetermined angle from the main extension portion toward a center of a cylinder; a main vertical portion bending downward toward the cylinder from the main inclined portion; and a main intake air outlet formed at an end portion of the main vertical portion. The long port may include an auxiliary extension portion extending from the main extension portion; an auxiliary inclined portion which is inclined at a predetermined angle from the auxiliary extension portion toward the center of the cylinder and inclined at a predetermined angle downward toward the cylinder; an auxiliary vertical portion bending downward from the auxiliary inclined portion; and an auxiliary intake air outlet at an end portion of the auxiliary vertical portion.

6 Claims, 6 Drawing Sheets

(56) References Cited

U.S. PATENT DOCUMENTS

| | | | | |
|---|---|---|---|---|
| 8,448,616 | B2 * | 5/2013 | Kirk | F01L 13/00 123/432 |
| 8,622,044 | B2 * | 1/2014 | Magro | F02F 1/4235 123/306 |
| 2019/0186442 | A1 * | 6/2019 | Kim | F02M 35/108 |

* cited by examiner

FIG. 6

| | Related art | Present invention |
|---|---|---|
| Cf | 0.352 | 0.425 |
| Increase and decrease | - | Improved by 28% |
| Rs | -0.440 | 0.006 |
| Increase and decrease | - | Reduced by 98% |

INTAKE PORT

CROSS-REFERENCE TO RELATED APPLICATION

This application claims priority to and the benefit of Korean Patent Application No. 10-2017-0174091, filed on Dec. 18, 2017, the entire contents of which are incorporated herein by reference.

FIELD

The present disclosure relates to an intake port, and in one form, to an intake port capable of reducing a swirl direction flow of intake air introduced into a cylinder of an engine.

BACKGROUND

The statements in this section merely provide background information related to the present disclosure and may not constitute prior art.

In general, intake air, which is introduced into a cylinder of an engine through an intake port, generates a tumble direction flow which rotates in a vertical direction in the cylinder, and a swirl direction flow which rotates in a horizontal direction in the cylinder.

In the related art, a large amount of intake air introduced into the cylinder flows in the swirl direction and is mixed with fuel injected through an injector so that combustion efficiency is improved.

In addition, in the case of a large-sized engine (e.g., an engine with a cylinder having a diameter of 100 mm or more) developed recently, the fuel may be injected at a high pressure by virtue of development of a fuel injection system. As the ultrahigh-pressure injection system is applied, the intake air introduced through the intake port rotates in the swirl direction, and we have discovered that the intake air hinders instantaneous combustion of atomized fuel particles by compression ignition.

The above information disclosed in this Background section is only for enhancement of understanding and therefore it may contain information that does not form the prior art that is already known to a person of ordinary skill in the art.

SUMMARY

The present disclosure describes, in one form, an intake port capable of reducing a swirl direction flow of intake air introduced into a cylinder.

The present disclosure provides an intake port which includes a short port and a long port, in which the short port includes: a main extension portion which extends from an intake air inlet through which intake air is introduced; a main inclined portion which is inclined at a predetermined angle from the main extension portion toward a center of a cylinder; a main vertical portion which is bent downward toward the cylinder from the main inclined portion; and a main intake air outlet which is formed at an end portion of the main vertical portion, and the long port includes: an auxiliary extension portion which extends from the main extension portion; an auxiliary inclined portion which is inclined at a predetermined angle from the auxiliary extension portion toward the center of the cylinder and inclined at a predetermined angle downward toward the cylinder; an auxiliary vertical portion which is bent downward from the auxiliary inclined portion; and an auxiliary intake air outlet which is formed at an end portion of the auxiliary vertical portion.

An area of the intake air inlet may be set to 1.4 to 2 times a sum of an area of the main intake air outlet and an area of the auxiliary intake air outlet.

A port height, which is defined as a distance from the auxiliary intake air outlet to an upper surface of the auxiliary extension portion, may be set to be equal to or more than 0.7 times an inner diameter of the cylinder.

A port horizontal angle, which is defined as an angle defined between the auxiliary extension portion and the auxiliary inclined portion, may be set to 15 degrees or less.

A port vertical angle, which is defined as an angle defined between the auxiliary inclined portion and an upper surface of the auxiliary extension portion, may be set to 10 degrees or less.

A lower surface of the intake air inlet may be inclined upward at a predetermined angle with respect to an upper surface of the cylinder.

The lower surface of the intake air inlet may be inclined at 10 degrees to 20 degrees with respect to the upper surface of the cylinder.

An intake port according to the present disclosure can inhibit a swirl direction flow from being generated in the cylinder by the intake air introduced into the cylinder through the intake port in the large-sized engine.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 6 is a table for comparing Rs and Cf of the intake port according to the present disclosure with Rs and Cf of an intake port in the related art.

Figure 1:
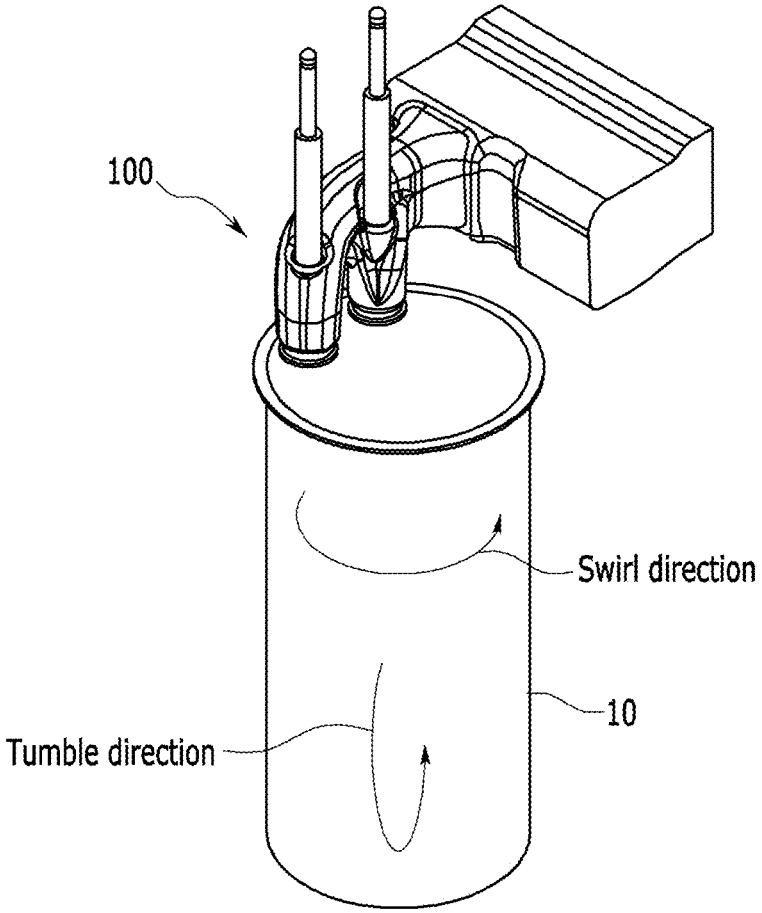
FIG. 1 is a perspective view illustrating configurations of an intake port and a cylinder according to an aspect of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

A part irrelevant to the description may be omitted from the drawings for clarity, and the same or similar constituent elements will be designated by the same reference numerals throughout the specification.

In addition, the size and thickness of each component illustrated in the drawings may optionally be shown for understanding and ease of description, but the present disclosure is not limited thereto. Thicknesses of several portions and regions may be enlarged for clearly describing the above.

Figure 2:
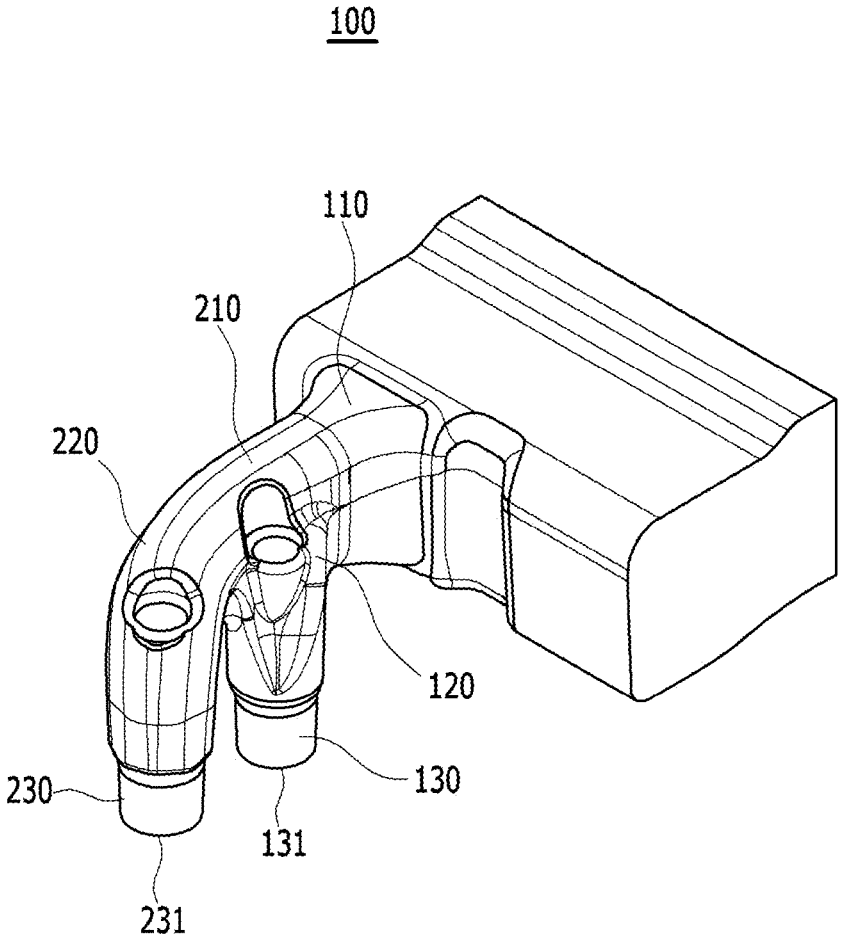
FIG. 2 is a perspective view illustrating the configuration of the intake port according to an aspect of the present disclosure.
Figure 3:
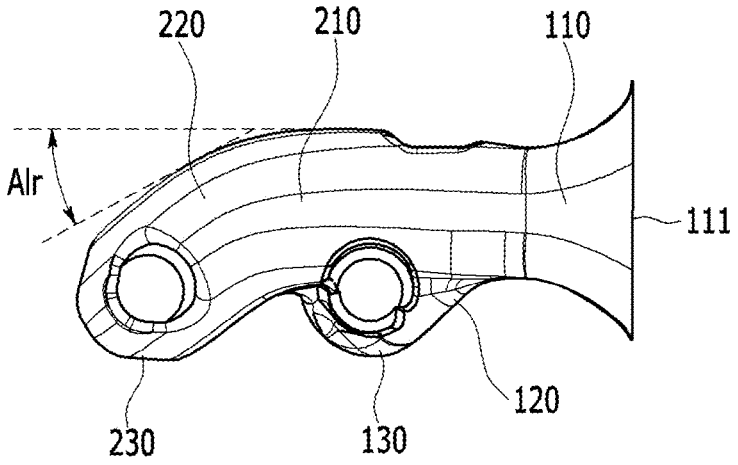
FIG. 3 is a top plan view illustrating the configuration of the intake port according to an aspect of the present disclosure.
Figure 4:
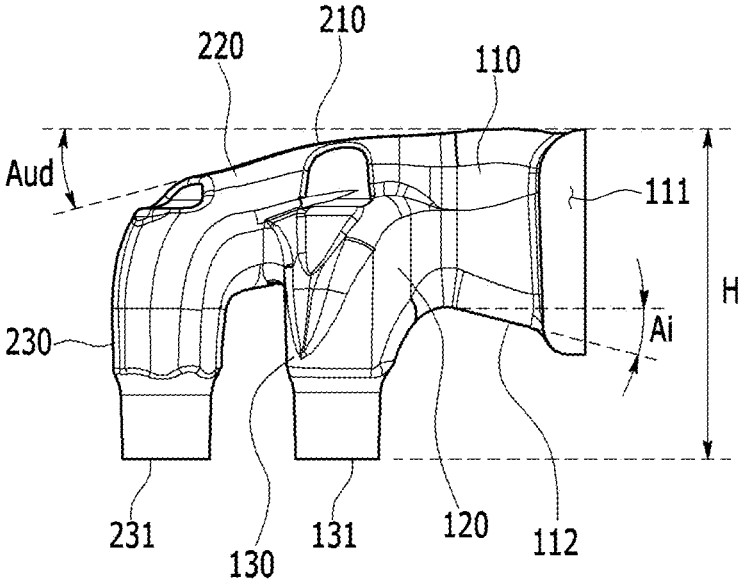
FIG. 4 is a side view illustrating the configuration of the intake port according to an aspect of the present disclosure.

FIG. 1 is a perspective view illustrating configurations of an intake port and a cylinder according to an aspect of the present disclosure. FIG. 2 is a perspective view illustrating the configuration of the intake port according to an aspect of the present disclosure. FIG. 3 is a top plan view illustrating a configuration of the intake port according to an aspect of the present disclosure. Further, FIG. 4 is a side view illustrating a configuration of the intake port according to an aspect of the present disclosure.

As illustrated in FIGS. 1 to 4, an intake port according to one aspect of the present disclosure may include a short port which is connected to an intake air outlet positioned relatively close to an intake air inlet 111 through which intake air is introduced, and a long port which is connected to an intake air outlet positioned relatively distant from the intake air inlet 111.

The short port may include a main extension portion 110, a main inclined portion 120 which is bent from the main extension portion 110 so as to be inclined at a predetermined angle, and a main vertical portion 130 which is bent from the main inclined portion 120.

The main extension portion 110 may have an intake air inlet 111 through which the intake air is introduced, and the main extension portion 110 extends and is spaced apart from a center of the cylinder 10 at a predetermined interval. The main inclined portion 120 may be inclined at a predetermined angle from an end portion of the main extension portion 110 toward the center of the cylinder 10. The main vertical portion 130 may be bent downward toward the cylinder 10 from an end portion of the inclined portion. Further, a main intake air outlet 131, through which the intake air introduced from the intake air inlet 111 is discharged into the cylinder 10, is formed at an end portion of the main vertical portion 130.

The long port may include an auxiliary extension portion 210 which extends from the main extension portion 110, an auxiliary inclined portion 220 which is bent from the auxiliary extension portion 210 so as to be inclined at a predetermined angle, and an auxiliary vertical portion 230 which is bent from the auxiliary inclined portion 220.

The auxiliary extension portion 210 extends from the main extension portion 110 and extends in the same direction as the main extension portion 110. The auxiliary inclined portion 220 is bent from an end portion of the auxiliary extension portion 210 so as to be inclined at a predetermined angle toward the center of the cylinder 10 and inclined downward at a predetermined angle toward the cylinder 10. The auxiliary vertical portion 230 is bent downward toward the cylinder 10 from an end portion of the auxiliary inclined portion 220. Further, an auxiliary intake air outlet 231, through which the intake air introduced from the intake air inlet 111 is discharged into the cylinder 10, is formed at an end portion of the auxiliary vertical portion 230.

An area of the intake air inlet 111 may be set to 1.4 to 2 times a sum of an area of the main intake air outlet 131 and an area of the auxiliary intake air outlet 231. As described above, the area of the intake air inlet 111 is sufficiently larger than the sum of the area of the main intake air outlet 131 and the area of the auxiliary intake air outlet 231, such that a vertical direction flow is generated when the intake air is discharged into the cylinder 10 through the main intake air outlet 131 and the auxiliary intake air outlet 231, and as a result, a swirl direction flow is reduced.

To inhibit the intake air introduced through the intake air inlet 111 from generating the swirl direction flow in the cylinder 10, the shape of the intake port may cause a reduction in the rotational component generated while the intake air introduced through the intake air inlet 111 passes through the short port and the long port.

As illustrated in FIG. 4, assuming that a distance from the auxiliary intake air outlet 231 to an upper surface of the auxiliary extension portion 210 is defined as a port height H, the port height may be set to 0.7 times an inner diameter of the cylinder 10. For example, when the inner diameter of the cylinder 10 is 100 mm, the port height may be set to 70 mm.

As described above, when the port height of the intake port 100 is sufficiently greater than the inner diameter of the cylinder 10, a vertical direction flow is generated when the intake air is discharged into the cylinder 10 through the auxiliary intake air outlet 231 of the auxiliary vertical portion 230, and as a result, a swirl direction flow is reduced.

As illustrated in FIG. 3, assuming that an angle, which is defined between the auxiliary extension portion 210 and the auxiliary inclined portion 220 in a plan view, is defined as a port horizontal angle Alr, the port horizontal angle may be set to 15 degrees or less. As described above, when the port horizontal angle is set to a small value of 15 degrees or less, a swirl direction flow is reduced when the intake air is introduced into the auxiliary vertical portion 230 through the auxiliary extension portion 210 and then discharged into the cylinder 10.

Referring back to FIG. 4, assuming that an angle, which is defined in the vertical direction between the auxiliary inclined portion 220 and the upper surface of the auxiliary extension portion 210, is defined as a port vertical angle Aud, the vertical angle may be set to 10 degrees or less. As described above, when the port vertical angle is set to a small value of 10 degrees or less, a swirl direction flow may be reduced when the intake air is introduced into the auxiliary vertical portion 230 through the auxiliary extension portion 210 and then discharged into the cylinder 10.

Meanwhile, referring to FIG. 2, the intake air inlet 111 is formed in an approximately quadrangular shape, and a lower surface of the intake air inlet 111 may be inclined upward at a predetermined angle with respect to an upper surface of the cylinder 10. In this case, an inlet inclination angle Ai defined by the lower surface of the intake air inlet 111 may be 10 degrees to 20 degrees with respect to the upper surface of the cylinder 10. As described above, when the lower surface of the intake air inlet 111 is inclined upward with respect to the upper surface of the cylinder 10, the intake air introduced through the intake air inlet 111 generates a flow component directed toward an upper side of the cylinder 10, and as a result, a swirl direction flow may be reduced when the intake air is introduced into the auxiliary vertical portion 230.

Figure 5:
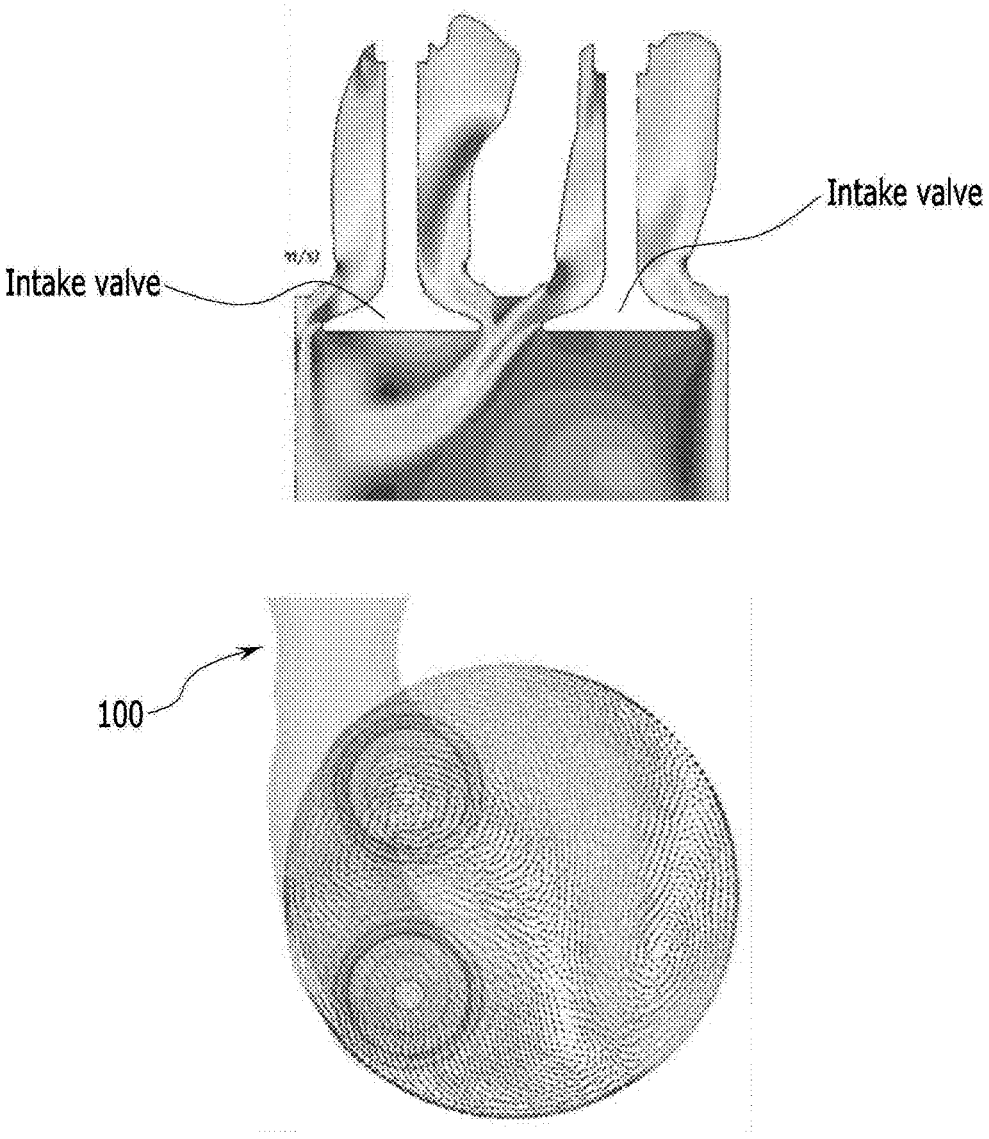
FIG. 5 is a view illustrating a simulation result regarding a flow of intake air introduced through the intake port according to an aspect of the present disclosure.

FIG. 5 is a view illustrating a simulation result regarding a flow of intake air introduced through the intake port 100 according one aspect of the present disclosure. Further, FIG. 6 is a table for comparing Rs and Cf of an intake port according to the present disclosure with Rs and Cf of an intake port in the related art.

FIG. 5 illustrates a simulation result regarding a flow velocity of intake air when an intake valve is raised by 10 mm. Further, Rs in FIG. 6 means a flow coefficient of intake air, and the flow coefficient of intake air means a ratio of the amount of intake air, which is actually introduced, to an increased amount of intake air which may be introduced through the intake air inlet 111 at a particular pressure. In one form, Rs may be 0.5 or more. Further, Cf means an intake flow coefficient.

As illustrated in FIG. 5, it can be seen that a swirl direction flow is rarely generated according to an intake port according to the present disclosure.

Further, referring to FIG. 6, it can be seen that Cf is increased from 0.352 to 0.425 and thus improved by about 28% according to an intake port of the present disclosure. Further, it can be seen that Rs is increased from −0.440 to 0.006 and thus reduced by about 98%. That is, Rs is converged almost on zero (0), and thus it can be said that effectively no swirl port is implemented.

As described above, Rs is converged almost on zero (0), and Cf is increased in comparison with the related art, and as a result, fuel economy of a vehicle is improved by about 0.2%.

In an intake port as described above, the area, the port height, the port horizontal angle, the port vertical angle of the intake air inlet 111, which define the shape of the intake port, and a gradient of the intake air inlet 111 may inhibit a swirl direction flow from being generated in the cylinder 10 by the intake air supplied into the cylinder 10 through the intake port, and as a result, it is possible to improve fuel economy of a vehicle.

It will be noted that the present disclosure is not limited to the foregoing description, and various modifications can be made and carried out within the scope of the claims, the detailed description, and the accompanying drawings, and also fall within the scope of the present disclosure.

DESCRIPTION OF SYMBOLS

10: Cylinder
100: Intake port
110: Main extension portion
111: Intake air inlet
120: Main inclined portion
130: Main vertical portion
131: Main intake air outlet
210: Auxiliary extension portion
220: Auxiliary inclined portion
230: Auxiliary vertical portion
231: Auxiliary intake air outlet

What is claimed is:

1. An intake port comprising:
a short port comprising:
a main extension portion extending from an intake air inlet through which intake air is introduced;
a main inclined portion inclined at a predetermined angle from the main extension portion toward a center of a cylinder;
a main vertical portion bending downward toward the cylinder from the main inclined portion; and
a main intake air outlet formed at an end portion of the main vertical portion, and
a long port comprising:
an auxiliary extension portion extending from the main extension portion;
an auxiliary inclined portion inclined at a predetermined angle from the auxiliary extension portion toward the center of the cylinder and inclined at a predetermined angle downward toward the cylinder;
an auxiliary vertical portion bending downward from the auxiliary inclined portion; and
an auxiliary intake air outlet formed at an end portion of the auxiliary vertical portion,
wherein:
a lower surface of the intake air inlet is inclined upward at a predetermined angle with respect to an upper surface of the cylinder, and
the lower surface of the intake air inlet is inclined at 10 degrees to 20 degrees with respect to the upper surface of the cylinder.

2. The intake port of claim 1, wherein the intake air inlet has an area 1.4 to 2 times a sum of an area of the main intake air outlet and an area of the auxiliary intake air outlet.

3. The intake port of claim 1, wherein a port height comprising a distance from the auxiliary intake air outlet to an upper surface of the auxiliary extension portion, is equal to or greater than 0.7 times an inner diameter of the cylinder.

4. The intake port of claim 1, wherein:
a port horizontal angle defined between the auxiliary extension portion and the auxiliary inclined portion is 15 degrees or less.

5. The intake port of claim 1, wherein:
a port vertical angle defined between the auxiliary inclined portion and an upper surface of the auxiliary extension portion is 10 degrees or less.

6. An intake port for a cylinder having a center and extending vertically, the intake port comprising:
an intake air inlet through which intake air is introduced;
a short port comprising a main extension portion, a main inclined portion, a main vertical portion, and a main intake air portion, wherein the main extension portion extends from the intake air inlet, and wherein the main inclined portion is inclined at a predetermined angle from the main extension portion toward the center of the cylinder, and wherein the main vertical portion bending downward toward the cylinder from the main inclined portion, and wherein a main intake air outlet is formed at an end portion of the main vertical portion; and
a long port comprising an auxiliary extension portion, an auxiliary inclined portion, an auxiliary vertical portion, and an auxiliary intake air outlet, wherein the auxiliary extension portion extends from the main extension portion, and wherein the auxiliary inclined portion is inclined at a predetermined angle from the auxiliary extension portion toward the center of the cylinder and inclined at a predetermined angle downward toward the cylinder, and wherein the auxiliary vertical portion bends downward from the auxiliary inclined portion, and wherein an auxiliary intake air outlet is formed at an end portion of the auxiliary vertical portion,
wherein:
a lower surface of the intake air inlet is inclined upward at a predetermined angle with respect to an upper surface of the cylinder, and
the lower surface of the intake air inlet is inclined at 10 degrees to 20 degrees with respect to the upper surface of the cylinder.

* * * * *